US005806766A

United States Patent [19]

Krueger et al.

[11] Patent Number: 5,806,766

[45] Date of Patent: Sep. 15, 1998

[54] INJECTION VALVE

[75] Inventors: Hinrich Krueger, Regensburg; Wendelin Kluegl, Seubersdorf, both of Germany

[73] Assignee: Siemens Aktiengesellschaft, Munich, Germany

[21] Appl. No.: 853,159

[22] Filed: May 8, 1997

[30] Foreign Application Priority Data

May 8, 1996 [DE] Germany ..... 196 18 468.1

[51] Int. Cl.[6] ..... B05B 9/00; F02M 41/16

[52] U.S. Cl. ..... 239/96; 239/90; 239/124; 239/533.2; 239/585.1; 251/29; 251/30.01

[58] Field of Search ..... 239/88, 90, 91, 239/960, 124, 533.1, 533.2, 533.3, 533.4, 533.5, 533.9, 585.1, 585.2; 251/29, 30.01

[56] References Cited

U.S. PATENT DOCUMENTS 4,463,901 8/1984 Perr et al. ..... 239/124 X
4,758,169 7/1988 Steiger ..... 239/96
5,154,350 10/1992 Ausiello et al. ..... 239/96
5,671,715 9/1997 Tsuzuki ..... 239/96 X

FOREIGN PATENT DOCUMENTS 0 426 205 7/1993 European Pat. Off. .

*Primary Examiner*—Andres Kashnikow
*Assistant Examiner*—Robin O. Evans
*Attorney, Agent, or Firm*—Herbert L. Lerner; Laurence A. Greenberg

[57] ABSTRACT

An electrohydraulically actuatable injection valve includes a control piston which divides an annular conduit from a control chamber disposed between the control piston and an actuator rod. A spring is disposed between the control piston and the actuator rod. The annular conduit also communicates through a control valve with a drain. If the control valve is closed with the injection valve open, the control piston opens a communication between the annular conduit and the control chamber, so that a nozzle needle is pressed onto an associated valve seat and abruptly stops the injection.

10 Claims, 4 Drawing Sheets

INJECTION VALVE

BACKGROUND OF THE INVENTION

FIELD OF THE INVENTION

The invention relates to an injection valve for injecting fuel into an internal combustion engine, including a housing having an actuator bore, a movable actuator rod in the actuator bore, the actuator rod having a nozzle needle pressed against a valve seat in a closed state of the injection valve, the valve seat having an injection opening, a control bore adjoining the actuator bore, a movable control piston in the control bore, a spring element disposed between the actuator rod and the control piston for defining a control chamber between the control piston and the actuator rod, and an inflow in the housing communicating through lines with the control chamber and through a control valve with a drain.

European Patent 0 426 205 B1 has already disclosed an electrohydraulic injection valve that has a control piston which is spaced apart by a spring from an actuator rod, so that a control chamber is formed between the control piston and the actuator rod. On one end, the actuator rod merges with a nozzle needle, which cooperates with a valve seat having injection openings. Fuel is carried through a line in the interior of the control piston into the control chamber.

The line in the control piston communicates with an outflow line through an electromagnetically actuatable control valve. The control piston is pressed by the spring against a sealing surface of a stop element, in which lines are disposed that extend from the sealing surface to a fuel inlet.

The injection valve described above is relatively complicated to produce.

SUMMARY OF THE INVENTION

It is accordingly an object of the invention to provide an injection valve, which overcomes the hereinaforementioned disadvantages of the heretofore-known devices of this general type, which is relatively simply constructed and which enables rapid closure.

With the foregoing and other objects in view there is provided, in accordance with the invention, an injection valve for injecting fuel into an internal combustion engine, comprising a housing having an actuator bore, a control bore adjoining the actuator bore, an inflow and a sealing surface all formed in the housing; a valve seat having an injection opening formed therein; a movable actuator rod disposed in the actuator bore, the actuator rod having a nozzle needle pressed against the valve seat in a closed state of the injection valve; a drain; a control valve communicating between the inflow and the drain; a control piston movable in the control bore, the control piston having a peripheral region, an interior and a pressure chamber in the interior communicating with the drain; a spring element disposed between the actuator rod and the control piston, the spring element defining a control chamber between the control piston and the actuator rod, the control chamber communicating with the pressure chamber, and the spring element exerting a spring force for pressing the control piston against the sealing surface; and lines communicating between the inflow and the control chamber, the lines including an annular conduit in the peripheral region of the control piston to be sealing off from the control chamber by the control piston pressing against the sealing surface, and the lines including an inflow bore communicating between the annular conduit and the pressure chamber; the control piston moving counter to the spring force of the spring element for creating direct communication between the annular conduit and the control chamber.

One substantial advantage of the injection valve of the invention is that an annular conduit is formed on the outside of the control piston and communicates with a fuel inlet and the control piston seals off the annular conduit from the control chamber. The annular conduit can be made to communicate with the control chamber through a motion of the control piston counter to a spring element. In this way it is possible for the pressure in the control chamber to be raised very quickly, as a result for the actuator rod to be pressed downward and thus for the nozzle needle of the injection valve to be pressed against the associated valve seat, thus abruptly interrupting the injection.

The injection valve according to the invention is also simple to manufacture.

In accordance with another feature of the invention, the control bore and the actuator bore have a transition therebetween defining the sealing surface, the sealing surface radially encompasses the transition and tapers conically toward the control bore, the actuator bore has an interior, the control piston extends as far as the interior of the actuator bore, and the control piston has a shape adapted to the sealing surface in the vicinity of the sealing surface for sealing off the sealing surface with the control piston.

In accordance with a further feature of the invention, there is provided an inflow throttle between the annular conduit and the pressure chamber, an outflow throttle between the pressure chamber and the drain, and a control throttle between the pressure chamber and the control chamber.

In accordance with an added feature of the invention, the inflow throttle has a smaller opening cross section than the outflow throttle.

In accordance with an additional feature of the invention, there is provided a valve plate, and a pressure plate between the housing and the valve plate, the pressure plate having the outflow throttle.

In accordance with yet another feature of the invention, the housing includes at least a first part containing the actuator bore and a second part containing the control bore.

In accordance with yet a further feature of the invention, there is provided a bush introduced into the control bore and defining an annular chamber between the housing and the bush, the annular chamber communicating with the inflow.

In accordance with yet an added feature of the invention, the control valve is a needle valve with a flat sealing seat.

In accordance with yet an additional feature of the invention, there is provided a conical seat communicating with the outflow throttle and a ball associated with the conical seat, the control valve having a valve needle pressing the ball against the conical seat.

In accordance with a concomitant feature of the invention, there is provided a conically tapering tap bore communicating with the outflow throttle, the control valve being a needle valve having a conically tapering valve needle sealing off the conically tapering tap bore.

Other features which are considered as characteristic for the invention are set forth in the appended claims.

Although the invention is illustrated and described herein as embodied in an injection valve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
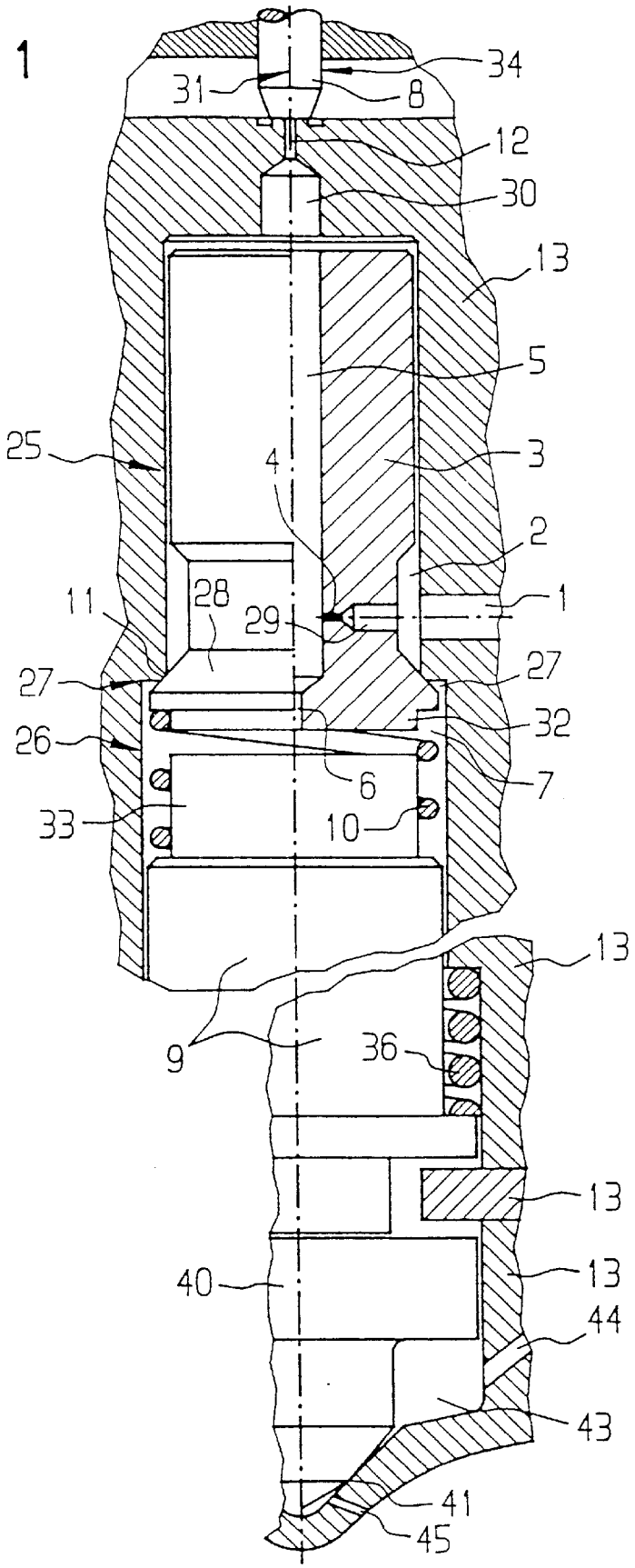
FIG. 1 is a fragmentary, diagrammatic, longitudinal-sectional view of an injection valve.

Referring now to the figures of the drawings in detail and first, particularly, to FIG. 1 thereof, there is seen an injection valve with a housing 13, in which a cylindrical control bore 25 is formed. The control bore is adjoined by a cylindrical actuator bore 26. A cylindrical control piston 3 is disposed in the control bore 25 and extends into the actuator bore 26. A closure piece 28 of the control piston 3 widens conically toward the actuator bore 26. An annularly encompassing sealing surface 27 is formed in the housing 13 in a transition region from the control bore 25 to the actuator bore 26. This surface 27 makes a conical transition from a larger diameter of the actuator bore 26 to a smaller diameter of the control bore 25. The sealing surface 27 and the closure piece 28 of the control piston 3 form an annularly encompassing sealing seat 11. An inlet bore or inflow 1 for fuel is made in the housing 13 above the sealing seat 11. The control piston 3 has an annularly encompassing recess at the level of the inlet bore 1, so that an annular conduit 2 is formed in this region between the control piston 3 and a wall surface of the housing 13. An inlet bore 29 begins at the annular conduit 2 and leads radially toward a center line of the control piston 3 to an inlet throttle 4, which leads to a pressure chamber 5 disposed in the axial direction of the control piston 3. The pressure chamber 5 extends upward in the direction of an outflow bore 30, which is formed in the housing 13 symmetrically to a center line of symmetry 31 above the control piston 3. The pressure chamber 5 communicates with the control bore 25. The outflow bore 30 merges with an outflow throttle 12 and leads to an electromagnetically actuatable control valve 8, which connects the outflow throttle 12 with a drain 34.

The pressure chamber 5 merges in the direction of the actuator bore 26 with a control throttle 6. The control throttle 6 discharges into a control chamber 7 that is formed between the control piston 3 and an actuator rod 9 disposed in the actuator bore 26. The control piston 3 has a first cylindrical centering piece 32 adjacent the control chamber 7. The actuator rod 9, which is adjacent the control chamber 7, has a second cylindrical centering piece 33, which has a smaller diameter than the actuator rod 9. A first spring 10, which encompasses both the first and the second centering pieces 32, 33, is disposed in the control chamber 7 between the control piston 3 and the actuator rod 9. The first spring 10 assures spacing between the control piston 3 and the actuator rod 9, so that the control chamber 7 is formed. The first spring 10 also presses a nozzle needle 40, which is adjacent the actuator rod 9, onto a valve seat 41, so that injection ports 45 of the injection nozzle are separate from the fuel delivery. A fuel chamber 43 which is formed between the nozzle needle 40 and the housing 13, is supplied with fuel through a fuel inlet 44. Elements 2, 29, 4, 5, 6 and 30 may be considered lines communicating between the inflow 1 and the control chamber 7.

A second spring 36 which acts parallel to the force of the spring 10 presses the actuator rod 9 against the valve seat 41 and is supported in the process against the housing 13. In this way, the force with which the control piston 3 is pressed against the sealing seat 11 can be selected to be less than a closing force of the nozzle needle 40.

The control piston 3, the actuator rod 9, the control bore 25 and the actuator bore 26 are constructed radially symmetrically to the center line of symmetry 31.

The mode of operation of the injection valve will now be explained in conjunction with FIG. 1: In the closed state, the actuator rod 9 is in a closing position, in which the nozzle needle 40 is pressed against the valve seat 41 and the injection ports 45 of the injection nozzle are disconnected from the fuel supply. Therefore no injection takes place. In this state, fuel is forced through the inlet bore 1 into the annular conduit 2, and from there through the inlet bore 29 and the inflow throttle 4 into the pressure chamber 5 of the control piston 3. The fuel flows from the pressure chamber 5 through the control throttle 6 into the control chamber 7. In addition, the fuel seeks to escape from the pressure chamber 5 through the outflow bore 30 and the outflow throttle 12. However, in this state the electromagnetically actuatable control valve 8 is closed. The same pressure prevails in both the pressure chamber 5 and the control chamber 7. The actuator rod 9 is pressed in the direction of the valve seat 41 of the nozzle needle 40, since the fuel pressure in the control chamber 7 acts on a larger surface area of the actuator rod 9 than does the fuel pressure on the underside of the nozzle needle 40 in the fuel chamber 43. In this situation, the control piston 3 is retained by the first spring 10 at an upper stop, so that the control piston 3 is seated on the sealing seat 11 and seals off the annular conduit 2 from the control chamber 7.

If the control valve 8 is then opened, the fuel flows out through the outflow throttle 12 and through the drain 34. Since the fuel flowing in behind it must pass through the inflow throttle 4, the pressure in the pressure chamber 5 drops. The consequence is that fuel flows out of the control chamber 7 into the pressure chamber 5. The fuel pressure thereupon drops in the control chamber 7, and the actuator rod 9 and therefore the nozzle needle 40 as well are lifted by the fuel pressure that is operative in the fuel chamber 43, and fuel is injected through the injection ports 45.

If the control valve 8 is then closed, fuel continues to flow through the inflow throttle 4 into the pressure chamber 5. Due to the control throttle 6, the pressure in the pressure chamber 5 initially rises faster than in the control chamber 7. As a consequence, a higher force acts upon the upper surface of the control piston 3 than on the lower surface, so that the control piston 3 is displaced downward counter to the first spring 10 and in the process lifts from the sealing seat 11, thus opening a direct communication between the annular conduit 2 and the control chamber 7. The consequence is that the fuel flows out of the inlet bore or inflow 1 through the annular conduit 2, directly through the entire cross section of the opened sealing seat 11 and into the control chamber 7. The fuel pressure thereupon rises abruptly in the control chamber 7, so that the nozzle needle 40 is pressed against the valve seat 41 and the injection ends abruptly.

Only a very slight throttling action occurs at the sealing seat 11 through the use of the first spring 10; in comparison with the inflow throttle 4 and the control throttle 6. If a pressure equilibrium is established between the pressure chamber 5 and the control chamber 7, then the control piston 3 is pressed upward again into its outset position by the first spring 10, so that the control piston 3 closes the sealing seat 11 again, and the annular conduit 2 is again disconnected from the control chamber 7.

Figure 2:
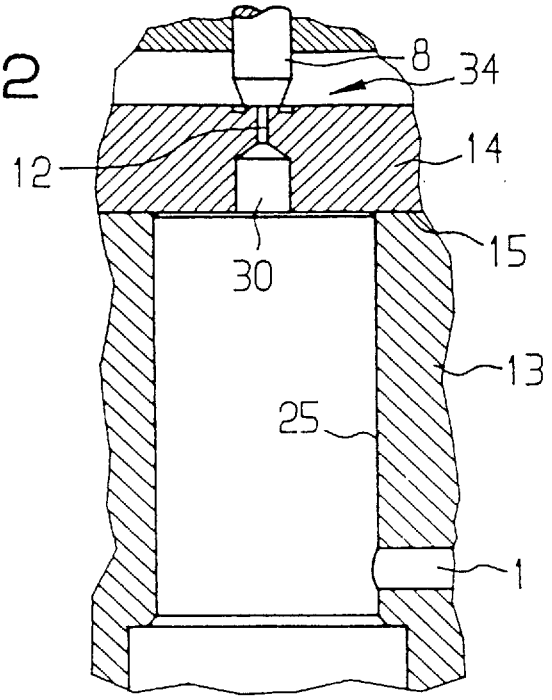
FIG. 2 is a fragmentary, longitudinal-sectional view of an injection valve with a pressure plate.

FIG. 2 shows a version of the injection valve with a split housing, in which a pressure plate 14 that closes off the control bore 25 in the direction of the control valve 8 is placed on the housing 13. The outflow bore 30, the outflow throttle 12 and the control valve 8 with the drain 34 are made in the pressure plate 14. The pressure plate 14 is screwed firmly to the housing 13 through a union nut. The sealing between the housing 13 and the pressure plate 14 is effected through a flat sealing seat 15. However, sealing through a cutting ring or a cone seat may also be employed. The version of the injection valve with a separate pressure plate has the advantage of making the control bore 25 easier to machine when the injection valve is manufactured.

Figure 3:
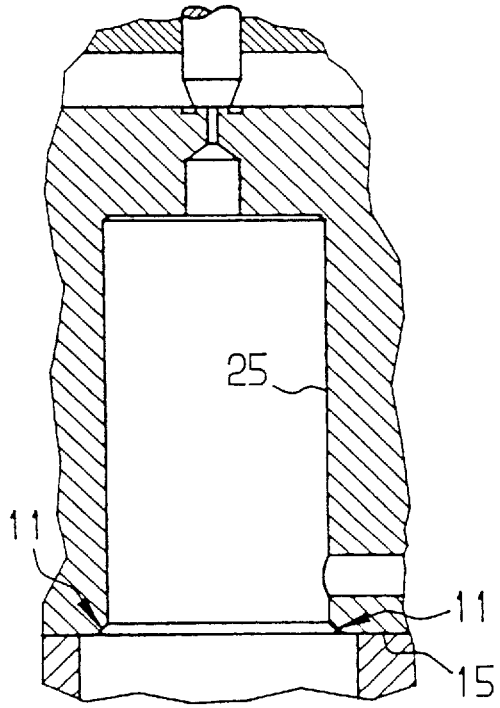
FIG. 3 is a fragmentary, longitudinal-sectional view of a two-part injection valve.

FIG. 3 shows a division of the housing 13 in which the flat sealing seat 15 is located at the height of the sealing seat 11. In this way, the conically tapering sealing seat 11 is easy to machine during manufacture. No adjustment problems between the control bore 25 and the sealing seat 11 occur, since the control bore 25 and the sealing seat 11 are made in the same housing part.

Figure 4:
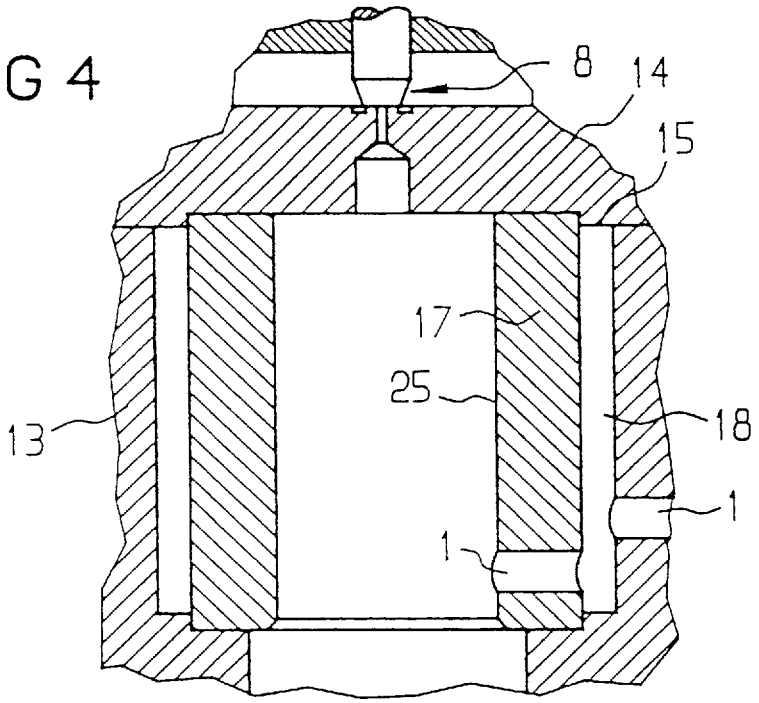
FIG. 4 is a fragmentary, longitudinal-sectional view of an injection valve with a bush.

FIG. 4 shows a further advantageous embodiment of the invention, in which the control bore 25 is closed off toward the control valve 8 with a pressure plate 14 as in FIG. 2, and a guide bush 17 is introduced into the control bore 25. Advantageously, the guide bush 17 is surrounded by an annular chamber 18, which is connected to the inlet bore or inflow 1. The use of the guide bush 17 offers the possibility of fabricating the guide bush 17 with precision and then introducing it into the housing 13.

The annular chamber 18, which covers the entire outer surface of the guide bush 17, offers the advantage of causing the fuel pressure present in the annular chamber 18 to prevent widening of the fuel bush 17 toward the outside. This reduces the widening of the gap between the control piston 3 and the guide bush 17.

Figure 5A:
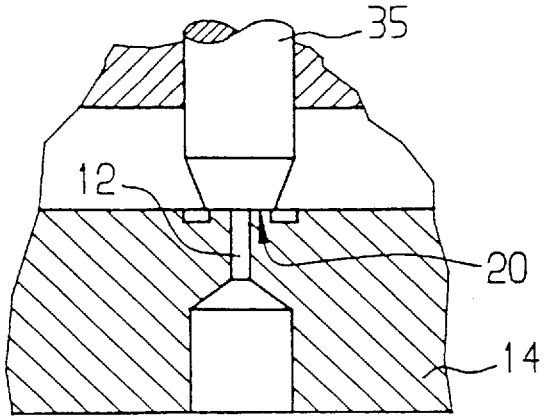
FIGS. 5*a*–5*c* are fragmentary, longitudinal-sectional views of various variants of a control valve.
Figure 5B:
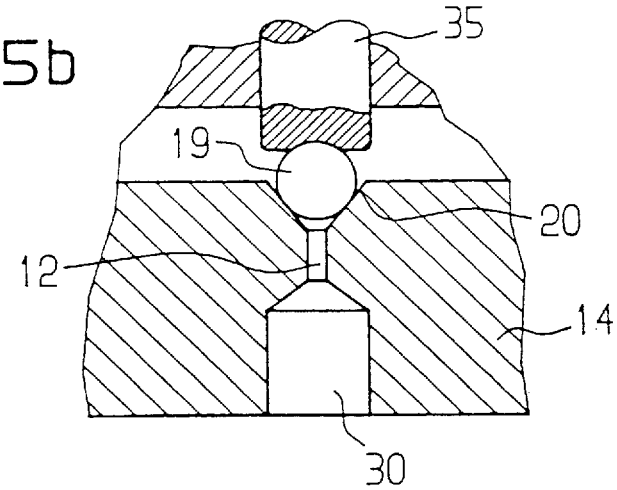
Figure 5C:
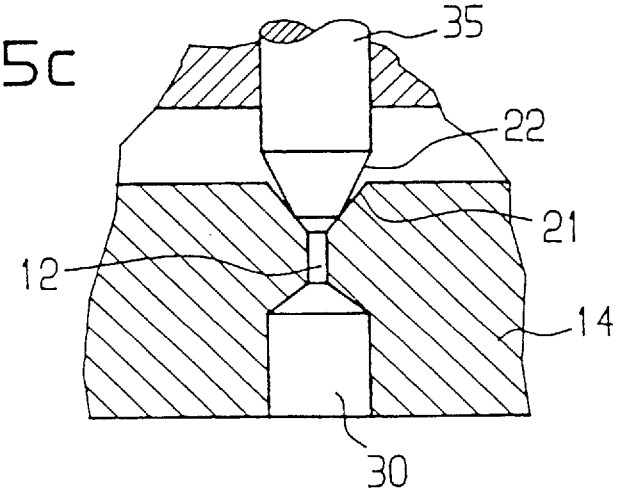

FIGS. 5*a*–5*c* show a plurality of advantageous embodiments of the outflow valve 8.

FIG. 5*a* shows a flat valve seat 20, in which a valve needle 35 tapers conically toward the valve seat 20 and merges with a sealing surface disposed parallel to the valve seat 20.

FIG. 5*b* shows a control valve 8, in which the valve needle 35 presses a ball 19 into a conical valve seat 20 and thus opens and closes the outflow throttle 12.

FIG. 5*c* shows a control valve 8, in which the valve needle 35 tapers conically toward the outflow throttle and rests on a likewise conically tapering bore 21. The conically tapering bore 21 tapers at a shallower angle than a conical tip 22 of the valve needle.

We claim:

1. An injection valve for injecting fuel into an internal combustion engine, comprising:

a housing having an actuator bore, a control bore adjoining said actuator bore, an inflow and a sealing surface all formed in said housing;

a valve seat having an injection opening formed therein;

a movable actuator rod disposed in said actuator bore, said actuator rod having a nozzle needle pressed against said valve seat in a closed state of the injection valve;

a drain;

a control valve communicating between said inflow and said drain;

a control piston movable in said control bore, said control piston having a peripheral region, an interior and a pressure chamber in said interior communicating with said drain;

a spring element disposed between said actuator rod and said control piston, said spring element defining a control chamber between said control piston and said actuator rod, said control chamber communicating with said pressure chamber, and said spring element exerting a spring force for pressing said control piston against said sealing surface; and lines communicating between said inflow and said control chamber, said lines including an annular conduit in said peripheral region of said control piston to be sealing off from said control chamber by said control piston pressing against said sealing surface, and said lines including an inflow bore communicating between said annular conduit and said pressure chamber;

said control piston moving counter to the spring force of said spring element for creating direct communication between said annular conduit and said control chamber.

2. The valve according to claim 1, wherein said control bore and said actuator bore have a transition therebetween defining said sealing surface, said sealing surface radially encompasses said transition and tapers conically toward said control bore, said actuator bore has an interior, said control piston extends as far as said interior of said actuator bore, and said control piston has a shape adapted to said sealing surface in the vicinity of said sealing surface for sealing off said sealing surface with said control piston.

3. The valve according to claim 1, including an inflow throttle between said annular conduit and said pressure chamber, an outflow throttle between said pressure chamber and said drain, and a control throttle between said pressure chamber and said control chamber.

4. The valve according to claim 3, wherein said inflow throttle has a smaller opening cross section than said outflow throttle.

5. The valve according to claim 3, including a valve plate, and a pressure plate between said housing and said valve plate, said pressure plate having said outflow throttle.

6. The valve according to claim 1, wherein said housing includes at least a first part containing said actuator bore and a second part containing said control bore.

7. The valve according to claim 1, including a bush introduced into said control bore and defining an annular chamber between said housing and said bush, said annular chamber communicating with said inflow.

8. The valve according to claim 1, wherein said control valve is a needle valve with a flat sealing seat.

9. The valve according to claim 3, including a conical seat communicating with said outflow throttle and a ball associated with said conical seat, said control valve having a valve needle pressing said ball against said conical seat.

10. The valve according to claim 3, including a conically tapering tap bore communicating with said outflow throttle, said control valve being a needle valve having a conically tapering valve needle sealing off said conically tapering tap bore.

* * * * *